US008162308B2

(12) United States Patent
Kobayashi et al.

(10) Patent No.: US 8,162,308 B2
(45) Date of Patent: Apr. 24, 2012

(54) PAPER SHEET PROCESSING DEVICE AND METHOD FOR CONTROLLING PAPER SHEET PROCESSING DEVICE

(75) Inventors: Hitoshi Kobayashi, Himeji (JP); Tsuguo Mizoro, Tatsuno (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 0 days.

(21) Appl. No.: 12/737,029

(22) PCT Filed: Jun. 4, 2008

(86) PCT No.: PCT/JP2008/060290
§ 371 (c)(1),
(2), (4) Date: Dec. 2, 2010

(87) PCT Pub. No.: WO2009/147736
PCT Pub. Date: Dec. 10, 2009

(65) Prior Publication Data

US 2011/0068528 A1 Mar. 24, 2011

(51) Int. Cl.
*B65H 39/00* (2006.01)

(52) U.S. Cl. ..... 270/60; 242/421.4; 242/421; 242/410; 242/412; 242/413

(58) Field of Classification Search ..... 270/60, 270/58.01; 242/410, 412, 412.1, 413, 421, 242/421.4
See application file for complete search history.

(56) References Cited

U.S. PATENT DOCUMENTS

| | | | | |
|---|---|---|---|---|
| 4,565,334 | A * | 1/1986 | Ruhl | 242/413.3 |
| 5,511,737 | A * | 4/1996 | Kang et al. | 242/355.1 |
| 5,735,516 | A * | 4/1998 | Gerlier et al. | 270/60 |
| 6,012,668 | A * | 1/2000 | Zurfluh et al. | 242/397.3 |
| 6,547,708 | B2 * | 4/2003 | Kawamura et al. | 493/84 |
| 6,669,136 | B2 * | 12/2003 | Niioka et al. | 242/528 |
| 7,490,823 | B2 * | 2/2009 | Oishi et al. | 271/3.01 |
| 7,494,122 | B2 * | 2/2009 | Spinetti | 271/216 |
| 7,618,040 | B2 * | 11/2009 | Mahler et al. | 271/314 |

FOREIGN PATENT DOCUMENTS

| | | |
|---|---|---|
| JP | 2000-123219 | 4/2000 |
| JP | 2004-123310 | 4/2004 |

* cited by examiner

*Primary Examiner* — Patrick MacKey
(74) *Attorney, Agent, or Firm* — Renner, Kenner, Greive, Bobak, Taylor & Weber

(57) ABSTRACT

The present invention avoids a problem in that wound-up banknotes are located unevenly on substantially the same position on a winding drum. The paper sheet processing device is configured to process paper sheets. The paper sheet processing device includes: a receiving unit configured to receive paper sheets one by one in a predetermined receiving cycle; a transport unit configured to transport the paper sheets received by the receiving unit; a storing and feeding unit including a winding drum that winds up the paper sheets together with a tape, the storing and feeding unit being configured to receive and feed the paper sheets transported by the transport unit, by winding up and winding off the tape; a drive unit configured to drive the receiving unit, the transport unit, and the storing and feeding unit: and a control unit configured to control the drive unit to maintain a tape winding amount per receiving cycle, such that a storing pitch of the paper sheets wound up by the winding drum deviates from a predetermined range relative to an outer peripheral length of the tape wound up by the winding drum.

8 Claims, 7 Drawing Sheets

PAPER SHEET PROCESSING DEVICE AND METHOD FOR CONTROLLING PAPER SHEET PROCESSING DEVICE

FIELD OF THE INVENTION

The present invention relates to a paper sheet processing device and a method for controlling the paper sheet processing device. In particular, the present invention relates to a paper sheet processing device including a paper sheet receiving and feeding device configured to receive and feed paper sheets in a winding manner, and a method for controlling the paper sheet processing device.

BACKGROUND ART

As a paper sheet receiving and feeding device configured to receive and feed paper sheets such as banknotes, there has been known, for example, a paper sheet receiving and feeding device including a winding drum that winds up paper sheets together with a tape (hereinafter referred to as "paper sheet receiving and feeding device of a winding type").

Conventionally, as a paper sheet receiving and feeding device of a winding type and a banknote processing device including the same, devices disclosed in JP8-67382A, JP2000-123219A and JP2005-293389A have been known, for example.

In the conventional banknote receiving and feeding device of a winding type, a pair of tapes or one tape and a winding drum are adapted to sandwich banknotes therebetween. When the winding drum winds up the tape(s), the banknotes are received and stored one by one. On the other hand, in the banknote receiving and feeding device, when the winding drum winds off the tape(s), the banknotes are fed one by one. In the banknote receiving and feeding device disclosed in JP2005-293389A, the drive of the drum is controlled such that a transport speed by the tape and a transport speed of a transport path are equal to each other, and that spacings between the banknotes to be stored are the same with each other.

Recently, the paper sheet processing device of a winding type has been required to have a smaller size but to have a larger capacity. As one of effective measures to cope with these requirements, it is considered to reduce a diameter of the winding drum of the banknote receiving and feeding device of a winding type.

However, when an outer peripheral length of the winding drum is smaller than a distance between a front edge of a wound-up banknote and a front edge of a banknote to be subsequently wound up (hereinafter referred to as "storing pitch"), an outer peripheral length of the tape is increased every time when the tape is wound up. Thus, the outer peripheral length of the tape and the storing pitch become substantially equal to each other, and this condition continues for a while. Under this condition, when a large number of banknotes are wound up in succession, the banknotes to be stored are unevenly wound, i.e., the banknotes are wound up on substantially the same position on the winding drum. Thus, the winding drum is divided into a section having a larger tape diameter and a section having a smaller tape diameter, when seen from the center of the winding drum. Since the thicknesses of the banknote and the tape are small, a considerably large number of banknotes have to be wound up until this condition is eliminated, which is achieved by an increase in the outer peripheral length of the tape. For example, when banknotes that are transported in a constant cycle are wound up in succession, there is a possibility that one hundred or more banknotes might be unevenly wound up on substantially the same position on the winding drum. In this case, since the center of gravity of the drum is displaced, it may be difficult to control the winding speed of the tape, and/or the tape may be caught by a guide disposed along the outer periphery of the drum when the drum winds off the tape. Herein, "substantially the same position on the winding drum" means substantially the same direction when seen from the center of the winding drum.

The above problem of unevenly winding up the banknotes to be stored on substantially the same position on the winding drum is described with reference to FIG. 11.

As shown in FIG. 11(*a*), in the conventional banknote processing device, a banknote having been transported along a transport path (banknote to be subsequently wound up) is wound up, together with a tape, by a winding drum. Herebelow, an outer diameter of the winding drum is represented as $d_1$, an outer peripheral length thereof is represented as $l_1$, an outer diameter of an outermost periphery of the tape wound up by the winding drum (hereinafter referred to as "outer diameter of the tape") is represented as $d_2$, and an outer peripheral length thereof (hereinafter referred to as "outer peripheral length of the tape") is represented as $l_2$. For example, the outer diameter $d_2$ of the tape is 49.3 mm. In addition, a storing pitch y between the banknotes to be wound up by the winding drum at a predetermined rotational speed is, e.g., 155 mm. In addition, a distance between a rear edge of the banknote wound up by the winding drum and a front edge of the banknote to be subsequently wound up, which reaches a contact point between the transport path and the tape wound up by the winding drum, (hereinafter referred to as "storing spacing") is e.g., 79 mm. At this time, the outer peripheral length $l_2$ of the tape is a product of the outer diameter $d_2$ of the tape and a constant $\pi$, i.e., a value thereof is about 155 mm. Namely, a difference between the outer peripheral length $l_2$ of the tape and the storing pitch y becomes extremely small. In this case, the front edge of the wound-up banknote and the front edge of the banknote to be subsequently wound up are located on substantially the same position on the winding drum.

As a result, as shown in FIG. 11(*b*), the banknotes are unevenly wound up, i.e., the wound-up banknotes are located on substantially the same position on the winding drum. This condition is eliminated, as the tape continues to be wound up together with the banknotes so that the outer peripheral length $l_2$ of the tape increases. However, since the tape and the banknotes are thin, when the tape is wound up only for a while, the increase in the outer peripheral length $l_2$ of the tape is small. That is, the problem continues for a long period of time.

Further, even when the outer diameter $d_1$ of the winding drum is smaller than 49.3 mm, as the tape is wound up together with the banknotes, the outer peripheral length $l_2$ of the tape approaches the storing pitch y. Also in this case, as shown in FIG. 11(*b*), the banknotes are unevenly wound up, i.e., the wound-up banknotes are located on substantially the same position on the winding drum.

On the other hand, when the storing pitch y between almost all the stored banknotes is sufficiently small relative to the outer peripheral length $l_2$ of the tape, the above problem does not occur. (In general, when the outer peripheral length $l_2$ of the tape approaches integral multiples of the storing pitch y, the above problem occurs. However, a case in which the outer peripheral length $l_2$ of the tape approaches k (k is an integer not less than 2) times the storing pitch y (i.e., $l_2$ substantially equals to k multiplied by y) can be handled similarly to a case in which the outer peripheral length $l_2$ of the tape approaches one time the storing pitch y (i.e., $l_2$ substantially equals to y). Hereafter, the case in which $l_2$ substantially equals to y is described.) For example, in the banknote receiving and feeding device disclosed in JP2000-123219A, the transport speed and the tape winding speed are substantially the same with each other, the storing pitch is substantially the same as the transport pitch, and the outer diameter $d_1$ of the winding drum is so large that the storing pitch y is sufficiently small relative to the outer peripheral length $l_1$ of the winding drum from the first. Owing to these design requirements, the above problem does not occur. On the other hand, in this banknote receiving and feeding device, if the diameter of the winding drum is reduced so that the outer peripheral length of the winding drum becomes smaller than the transport pitch, there is a possibility that the above problem might occur, because of the deviation from the above design requirements for preventing the problem.

In addition, in the banknote receiving and feeding device disclosed in JP8-67382A, the outer peripheral length of the tape is not considered. Further, in this banknote receiving and feeding device, the tape winding speed is larger than the transport speed. Thus, the storing pitch becomes larger than the transport pitch. Even when the outer peripheral length of the tape is larger than the transport pitch, the above problem may occur if the storing pitch is larger than the outer peripheral length of the tape.

In addition, in the banknote processing device disclosed in JP2005-293389A, the relationship between the outer diameter of the tape, when it is unevenly wound up, and the storing pitch is not considered. Thus, the above problem may occur in this banknote processing device.

DISCLOSURE OF THE INVENTION

The present invention has been made in view of the above circumstances. According to the present invention, by controlling a storing pitch between paper sheets to be wound up by a winding drum, a problem of unevenly winding up the paper sheets to be received on the winding drum can be avoided.

According to a first aspect of the present invention, there is provided a paper sheet processing device for processing paper sheets, the paper sheet processing device including: a receiving unit configured to receive paper sheets one by one in a predetermined receiving cycle; a transport unit configured to transport the paper sheets received by the receiving unit; a storing and feeding unit including a winding drum that winds up the paper sheets together with a tape, the storing and feeding unit being configured to receive and feed the paper sheets transported by the transport unit, by winding up and winding off the tape; a drive unit configured to drive the receiving unit, the transport unit, and the storing and feeding unit: and a control unit configured to control the drive unit to maintain a tape winding amount per receiving cycle, such that a storing pitch of the paper sheets wound up by the winding drum deviates from a predetermined range relative to an outer peripheral length of the tape wound up by the winding drum.

In the present invention, it is preferable that an outer peripheral length of the winding drum is smaller than a transport pitch of the paper sheets, which is determined based on the receiving cycle and a transport speed of the transport unit.

In the present invention, it is preferable that the storing pitch is smaller than the outer peripheral length of the winding drum.

In the present invention, it is preferable that the tape winding amount per receiving cycle is smaller than a transport distance of the transport unit per receiving cycle.

According to a second aspect of the present invention, there is provided a paper sheet processing device for processing paper sheets, the paper sheet processing device including: a receiving unit configured to receive paper sheets one by one in a predetermined receiving cycle; a transport unit configured to transport the paper sheets received by the receiving unit; a storing and feeding unit including a winding drum that winds up the paper sheets together with a tape, the storing and feeding unit being configured to receive and feed the paper sheets transported by the transport unit, by winding up and winding off the tape; a drive unit configured to drive the receiving unit, the transport unit, and the storing and feeding unit: and a control unit configured to control the drive unit to vary the storing pitch, such that a storing pitch of the paper sheets wound up by the winding drum deviates from a predetermined range relative to an outer peripheral length of the tape wound up by the winding drum.

In the present invention, it is preferable that the control unit is configured to vary the receiving cycle so as to vary the storing pitch.

In the present invention, it is preferable that the control unit is configured to vary a rotational amount of the winding drum per receiving cycle so as to vary the storing pitch.

According to a third aspect of the present invention, there is provided a method of controlling a paper sheet processing device including: a receiving unit configured to receive paper sheets one by one in a predetermined receiving cycle; a transport unit configured to transport the paper sheets received by the receiving unit; and a storing and feeding unit including a winding drum that winds up the paper sheets together with a tape, the storing and feeding unit being configured to receive and feed the paper sheets transported by the transport unit, by winding up and winding off the tape; wherein the respective units are controlled such that a storing pitch of the paper sheets wound up together with the tape deviates from a predetermined range relative to an outer peripheral length of the tape wound up by the winding drum.

BEST MODE FOR CARRYING OUT THE INVENTION

An embodiment of the present invention will be described herebelow with reference to the drawings. At first, a paper sheet processing device in an embodiment of the present invention is described. Next, a paper sheet receiving and feeding device in an embodiment of the present invention is described. Next, a basic concept of the embodiment of the present invention is described. Finally, process contents in embodiment of the present invention are described. The embodiment described herebelow is mere one of embodiments of the present invention, and does not limit the scope of the present invention.

<Paper Sheet Processing Device>

The structure of a banknote processing device as a paper sheet processing device in an embodiment of the present invention is firstly described with reference to FIG. 1. In the embodiment of the present invention, the paper sheets may include, in addition to banknotes, checks or vouchers, which may be made of paper or resin. Namely, the paper sheet processing device is not limited to a banknote processing device, but may be a device configured to process any other paper sheets or resin sheets.

Figure 1:
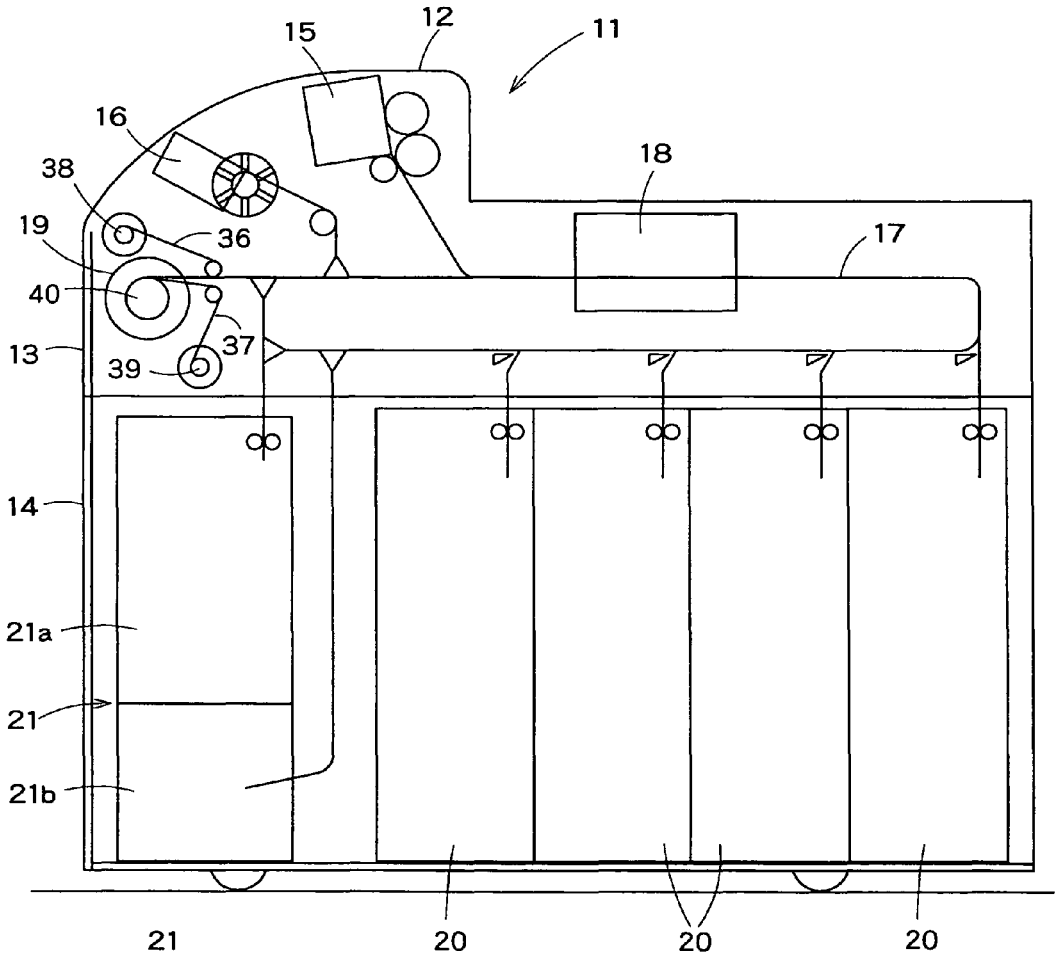
FIG. 1 is a plan view showing a structure of a banknote processing device 11 as a paper sheet processing device in an embodiment of the present invention.

FIG. 1 is a plan view showing the structure of a banknote processing device 11 as a paper sheet processing device in an embodiment of the present invention.

The banknote processing device 11 is a banknote deposit and dispense machine that deposits and dispenses banknotes as paper sheets. The banknote deposit and dispense machine includes an upper unit 13 and a lower unit 14, which can be drawn from a front surface of a machine body 12.

Formed in an upper part of a front surface of the upper unit 13 are an inlet 15 through which banknotes are deposited, and an outlet 16 through which banknote are dispensed. The inlet 15 serves as a receiving unit for receiving banknotes one by one in a predetermined receiving cycle. The inlet 15 is provided with a banknote feeding mechanism that feeds a transport path 17 with banknotes one by one in a predetermined receiving cycle.

In the upper unit 13, there are disposed the transport path 17 that transports banknotes, and a storing and feeding unit 19 that separately receives banknotes one by one and temporarily stores the same. The transport path 17 is a transport unit that transports the banknotes received by the inlet 15 at a predetermined transport speed. In the lower unit 14, stackers 20 for storing banknotes by denominations are aligned in the fore and aft direction, and a cassette 21 for storing banknotes is located in front of the stackers 20. The cassette 21 is provided with a storing unit 21*a* for storing banknotes, and a reject storing unit 21*b* for storing rejected banknotes. Each of the stackers 20 and the storing unit 21*a* of the cassette 21 is provided with a stacking mechanism for stacking banknotes transported thereto, and a banknote feeding mechanism for feeding the transport path 17 with banknotes one by one in a predetermined receiving cycle. The stackers 20 and the storing unit 21*a* of the cassette 21 serve as receiving units, which are different from the inlet 15.

The transport path 17 is constituted by a belt mechanism or a roller mechanism configured to transport banknotes, and has a loop-shaped transport path capable of transporting banknotes in two directions. In this loop-shaped transport path, a clockwise transport direction of banknotes in FIG. 1 is referred to as "regular direction", and a counterclockwise transport direction of banknotes is referred to as "reverse direction". Connected to the loop-shaped transport path are a deposit transport path along which banknotes are transported from the inlet 15, a dispense transport path along which banknotes are transported to the outlet 16, a receiving and feeding transport path along which banknotes are transported to and from the storing and feeding unit 19, a reject transport path along which banknotes are transported to the reject unit, stacker transport paths along which banknotes are transported to and from the respective stackers 20, and a cassette transport path along which banknotes are transported to and from the cassette 21. In addition, the loop-shaped transport path is equipped with a recognition unit 18 that recognizes banknotes, at a position between the deposit transport path and the last stacker transport path.

Figure 7:
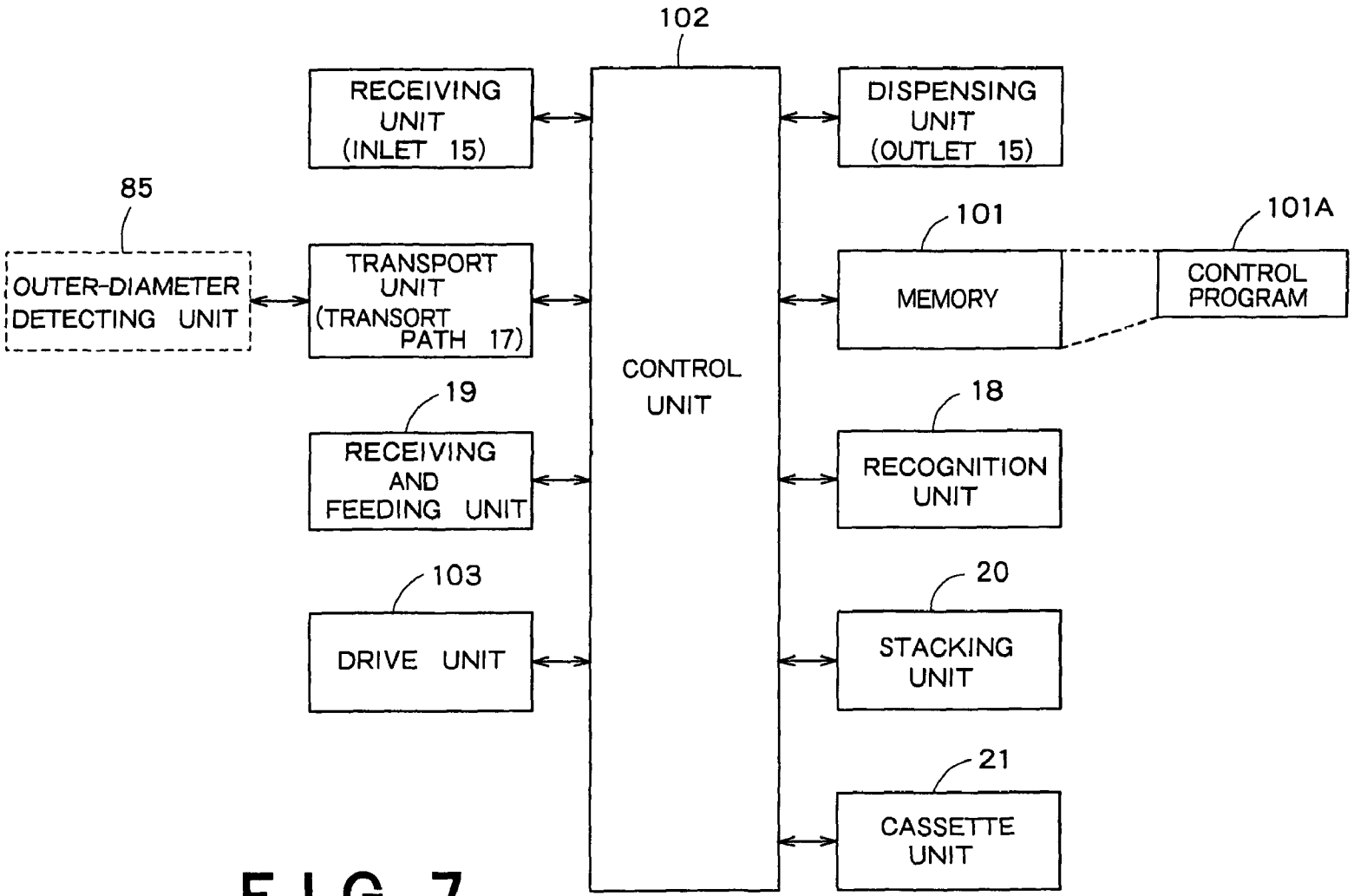
FIG. 7 is a block diagram showing control blocks of the banknote processing device 11 shown in FIG. 1.

FIG. 7 is a block diagram showing control blocks of the banknote processing device 11 shown in FIG. 1.

The banknote processing device 11 includes a memory 101, a control unit 102 and a drive unit 103.

The memory 101 is formed of a ROM or a RAM. The memory 101 stores a control program 101A and various data, and functions as a working memory of the control unit 102.

The control unit 102 is connected to the inlet 15 as a receiving unit, the outlet 16 as a dispensing unit, the transport path 17 as a transport unit, the recognition unit 18, the storing and feeding unit 19, the stackers 20 as stacking units, the cassette 21 as a cassette unit, the memory 101 and the drive unit 103. The control unit 102 is configured to control these respective units.

The drive unit 103 is a generic term of driving means provided on the banknote processing device 11. In accordance with a control command of the control unit 102, the drive unit 103 is configured to drive the inlet 15, the outlet 16, the transport path 17, the recognition unit 18, the storing and feeding unit 19, the stackers 20 and the cassette 21.

In this embodiment of the present invention, the memory 101, the control unit 102 and the drive unit 103 may be respectively disposed on the above units. In this case, under a control of the control unit 102 of the banknote processing device 11 functioning as a superordinate control unit, the above respective units are operated. Further, the control unit 102 can communicate with a control unit of a superordinate device, not shown, of the banknote processing device 11.

Figure 2:
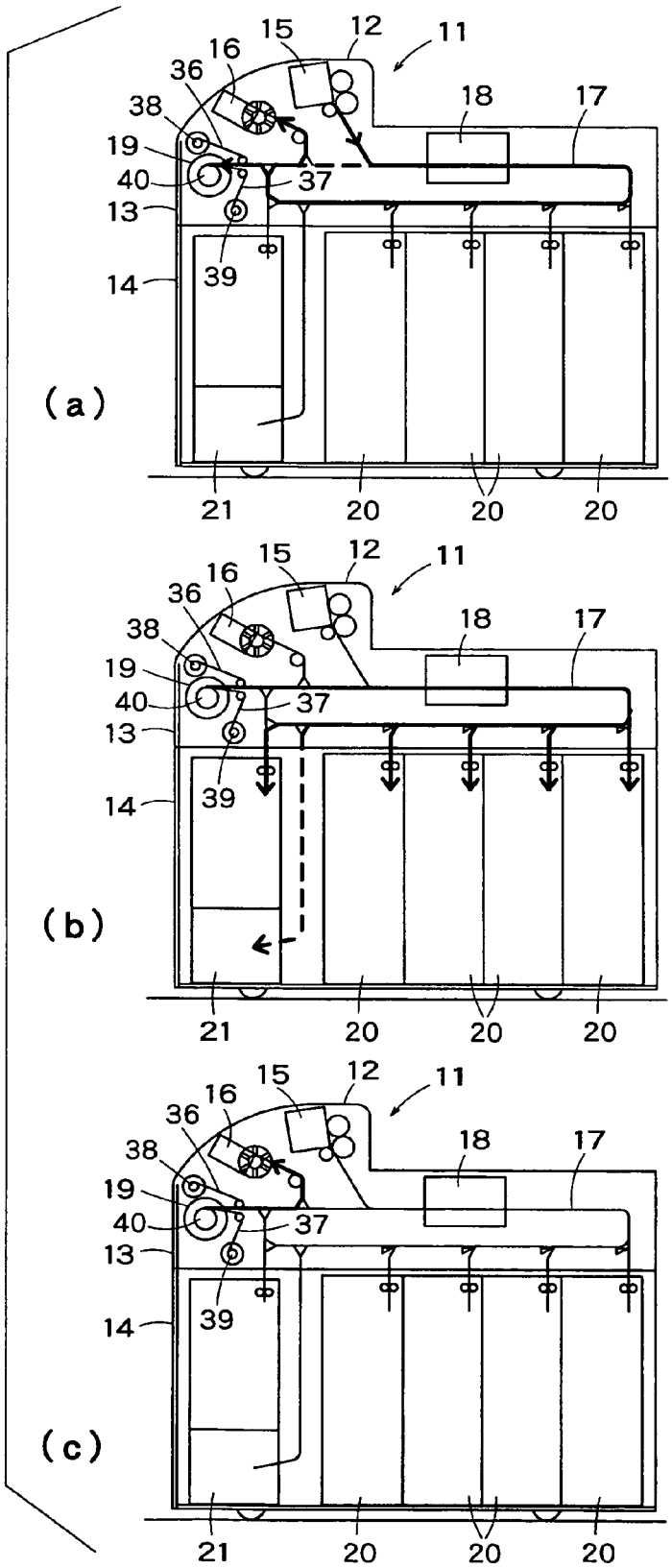
FIG. 2 is a plan view showing a transport course of banknotes in a deposit process of the banknote processing device 11 shown in FIG. 1.

Next, a deposit process of the banknote processing device 11 shown in FIG. 1 is described with reference to FIGS. 2(*a*) to 2(*c*). FIGS. 2(*a*) to 2(*c*) are plan views showing a transport course of banknotes in the deposit process of the banknote processing device 11 shown in FIG. 1. In FIGS. 2(*a*) to 2(*c*), the thick line shows a main transport course of banknotes.

Banknotes received in the inlet 15 are sent one by one from the deposit transport path to the loop-shaped transport path in the regular direction. The banknotes are transported along the loop-shaped transport path in the regular direction, and are recognized in the recognition unit 18.

The banknotes which are recognized as normal by the recognition unit 18 are diverged from the loop-shaped transport path to the receiving and feeding transport path, by a diverging mechanism located on a diverted position. The banknotes are separately received one by one by the storing and feeding unit 19, and are temporarily stored there.

Reject banknotes which are overlapped with each other during the transportation, for example, and thus reject a predetermined recognition process by the recognition unit 18, and banknotes which are recognized as reject banknotes that are not normal and cannot be re-recognized by the recognition unit 18, are sent to the outlet 16 so as to be returned.

After the process for temporarily storing the banknotes received in the inlet 15 has been finished, a deposit and storing command is issued. Then, as shown in FIG. 2(*b*), the banknotes stored in the storing and feeding unit 19 are fed one by one to the receiving and feeding transport path so as to be sent to the loop-shaped transport path in the regular direction. The banknotes are transported along the loop-shaped transport path in the regular direction, and are recognized by the recognition unit 18. This recognition process (hereinafter referred to as "re-recognition process") may be omitted, so that the deposit and storing process may be performed by using the recognition result obtained upon the deposit of the banknotes.

After the recognition, banknotes recognized as normal are sent to the stackers 20 by denominations and stored there.

When any of the stackers 20 of a certain denomination becomes full, overflow banknotes of the denomination are sent to the storing unit 21*a* of the cassette 21 and stored there.

Reject banknotes rejecting a predetermined recognition process by the recognition unit 18, and banknotes which are recognized as reject banknotes that are not normal and cannot be re-recognized by the recognition unit 18, are sent to the reject storing unit 21*b* of the cassette 21 and stored there.

When a deposit return command is issued, as shown in FIG. 2(*c*), the banknotes stored in the storing and feeding unit 19 are fed one by one to the receiving and feeding transport path, and are sent to the loop-shaped transport path in the regular direction. The banknotes are transported along the loop-shaped transport path in the regular direction, and are sent to the outlet 16 so as to be returned.

Figure 3:
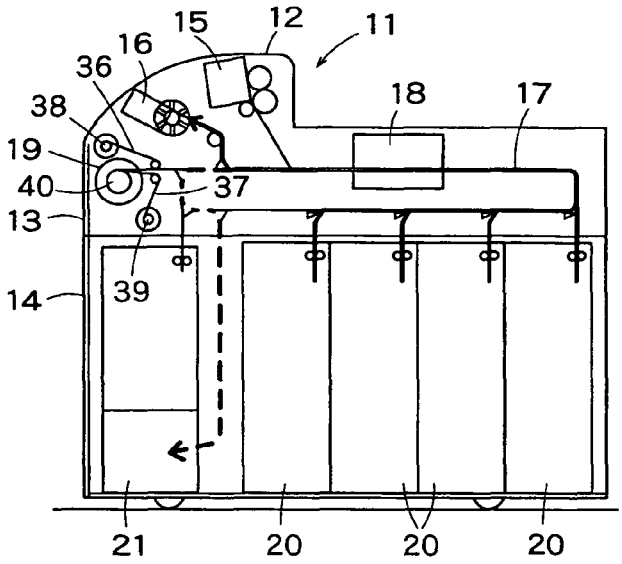
FIG. 3 is a plan view showing a transport course of banknotes in a dispense process of the banknote processing device 11 shown in FIG. 1.

Next, a dispensing process of the banknote processing device 11 shown in FIG. 1 is described with reference to FIG. 3. FIG. 3 is a plan view showing a transport course of banknotes in the dispensing process of the banknote processing device 11 shown in FIG. 1. In FIG. 3, the thick line shows a main transport course of banknotes.

In the dispensing process, banknotes stored in one of the stackers 20 corresponding to a denomination to be dispensed are fed one by one to the stacker transport path, and are sent to the loop-shaped transport path in the reverse direction. The banknotes are transported along the loop-shaped transport path in the reverse direction, and recognized by the recognition unit 18.

After the recognition, banknotes recognized as normal are sent from the loop-shaped transport path to the outlet 16 so as to be dispensed.

Reject banknotes which are overlapped with each other during the transportation, for example, and thus reject a predetermined recognition process by the recognition unit 18, and banknotes which are recognized as reject banknotes that are not normal and cannot be re-recognized by the recognition unit 18, are sent to the reject storing unit 21*b* of the cassette 21 and stored there.

Banknotes of the denomination that fall short of, because of banknotes which have been rejected, are fed again from the corresponding stacker 20.

Figure 4:
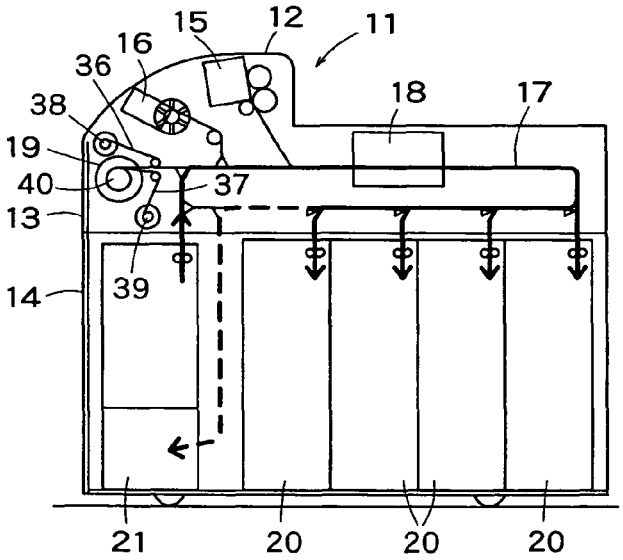
FIG. 4 is a plan view showing a transport course of banknotes in a replenishing process of the banknote processing device 11 shown in FIG. 1.

Next, a replenishing process of the banknote processing device 11 shown in FIG. 1 is described with reference to FIG. 4. FIG. 4 is a plan view showing a transport course of banknotes in the replenishing process of the banknote processing device 11 shown in FIG. 1. In FIG. 4, the thick line shows a main transport course of banknotes.

Banknotes stored in the cassette 21 are sent to the loop-shaped transport path in the regular direction. The banknotes are transported along the loop-shaped transport path in the regular direction, and recognized by the recognition unit 18.

After the recognition, banknotes recognized as normal are sent to the stackers 20 by denominations, respectively.

Reject banknotes which are overlapped with each other during the transportation, for example, and thus reject a predetermined recognition process by the recognition unit 18, and banknotes which are recognized as reject banknotes that are not normal and cannot be re-recognized by the recognition unit 18, are sent to the reject storing unit 21*b* of the cassette and stored there. Alternatively, it is also possible to replenish banknotes, not from the banknote cassette 21, but from the inlet 15.

Figure 5:
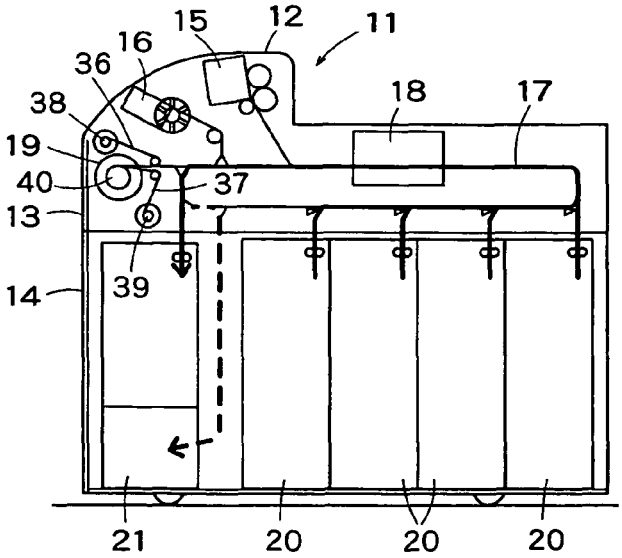
FIG. 5 is a plan view showing a transport course of banknotes in a collecting process of the banknote processing device 11 shown in FIG. 1.

Next, a collecting process of the banknote processing device 11 shown in FIG. 1 is described with reference to FIG. 5. FIG. 5 is a plan view showing a transport course of banknotes in the collecting process of the banknote processing device 11 shown in FIG. 1. In FIG. 5, the thick line shows a main transport course of banknotes.

The collecting process is a process in which banknotes stored in the stackers 20 are recognized, and thereafter collected into the cassette 21.

Banknotes stored in the stackers 20 are sequentially fed for each denomination one by one to the stacker transport path, and sent to the loop-shaped transport path in the reverse direction. The banknotes are transported along the loop-shaped transport path in the reverse direction, and recognized by the recognition unit 18.

After the recognition, banknotes recognized as normal are sent to the cassette 21 and stored there.

Reject banknotes which are overlapped with each other during the transportation, for example, and thus reject a predetermined recognition process by the recognition unit 18, and banknotes which are recognized as reject banknotes that are not normal and cannot be re-recognized by the recognition unit 18, are sent to the reject storing unit of the cassette 21 and stored there.

<Paper Sheet Receiving and Feeding Device>

Next, the storing and feeding unit 19 as a paper sheet receiving and feeding device of a winding type of the banknote processing device 11 shown in FIG. 1 is described with reference to FIG. 6. The paper sheet receiving and feeding device of a winding type can employ a method in which paper sheets are sandwiched between a pair of tapes, or a method in which paper sheets are sandwiched between one tape and a winding drum. However, the scope of the present invention is not limited thereto, and can be applied to any other methods.

Figure 6:
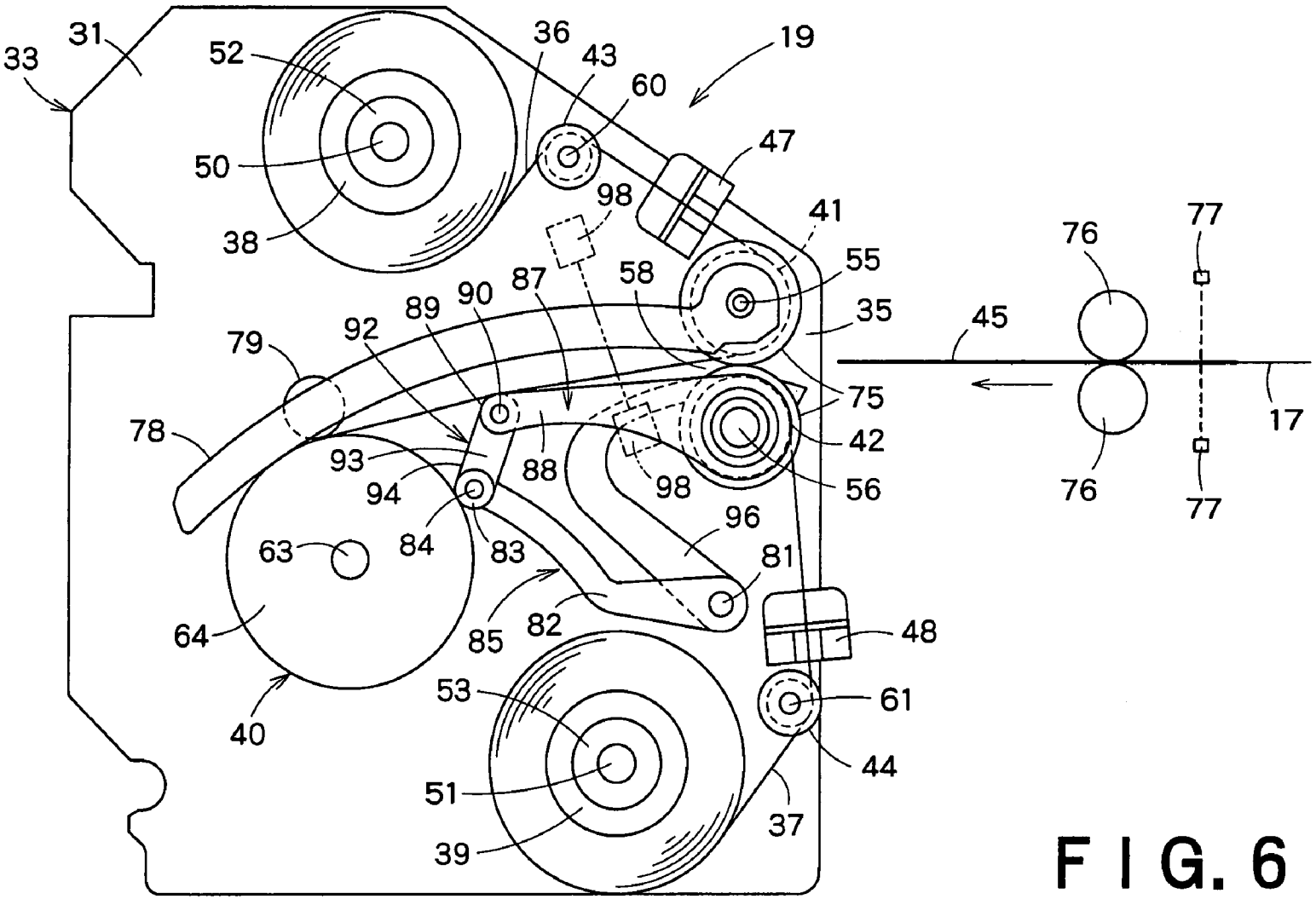
FIG. 6 is a sectional view of a storing and feeding unit 19 of the banknote processing device 11 shown in FIG. 1.

FIG. 6 is a sectional view of the storing and feeding unit 19 of the banknote processing device 11 shown in FIG. 1.

The storing and feeding unit 19 includes a frame 33 having opposed side plates 31, and a connection member, not shown, connecting these side plates 31.

Between the side plates 31 of the frame 33, there are arranged a banknote inlet/outlet port 35 opposed to the transport path 17, a first winding reel 38, a second winding reel 39, a winding drum 40, a first directing roller 41, a second directing roller 42, a first guide roller 43, and a second guide roller 44. One end of a first tape 36 is attached to the first winding reel 38, and thus the first tape 36 can be wound up by the first winding reel 38. One end of a second tape 37 is attached to the second winding reel 39, and thus the second tape 37 can be wound up by the second winding reel 39. The other ends of the tapes 36 and 37 are attached to the winding drum 40, and thus the tapes 36 and 37 can be wound up by the winding drum 40. The first and second directing rollers 41 and 42 are configured to direct the tapes 36 and 37 on positions opposite to the banknote inlet/outlet port 35. The first and second guide rollers 43 and 44 are configured to guide the tapes 36 and 37 between the respective winding reels 38 and 39 and the respective directing rollers 41 and 42.

The banknote inlet/outlet port 35 can receive a banknote 45 transported from the transport path 17, and can feed the banknote 45 to the transport path 17. When the banknote 45 is received, the tapes 36 and 37 are wound up by the winding drum 40, so that the banknote 45 received from the banknote inlet/outlet port 35 is sandwiched between the tapes 36 and 37, and is wound up by the winding drum 40 and stored there. On the other hand, when the banknote 45 is fed, the tapes 36 and 37 are wound off from the winding drum 40, so that the banknote 45 is fed toward the banknote inlet/outlet port 35.

Widths of the tapes 36 and 37 are smaller than a width of the banknote 45, and are about ⅙ to ⅓ of a length in a depth direction in FIG. 6. Ends of each tape in the longitudinal direction have marks indicating the ends thereof. For example, each tape is made of a transparent material. Portions near the ends are transparent and the other portion are colored and opaque. Marks for detecting a winding-up amount and a winding-off amount of each of the tapes 36 and 37 may be provided at predetermined intervals on one side in the width direction of the tape.

Between the directing roller 41 and the guide roller 43 and between the directing roller 42 and the guide roller 44, there are disposed a first winding amount sensor 47 and a second winding amount sensor 48 as winding amount detecting means for detecting the marks on the tapes 36 and 37. Due to these sensors 47 and 48, the ends of the tapes can be detected. When the marks at predetermined intervals are provided, it is possible to detect a speed and an acceleration based on a time, by using positions and winding amounts of the tapes 36 and 37, and by using a timer means (a time measuring means) additionally disposed.

A winding amount and/or a speed of the tape may be obtained from a commanded rotational amount of a motor or a commanded rotational speed thereof, and an outer diameter $d_2$ of the tape. The outer diameter $d_2$ of the tape may be actually measured, or may be obtained from a computation expression or a reference table showing a relationship between a value correlating to the outer diameter $d_2$ of the tape, such as the number of stored banknotes, and the outer diameter $d_2$ of the tape.

The respective winding reels 38 and 39 are flanged reels having flanges on opposite sides thereof. The winding reels 38 and 39 are respectively mounted on winding reel shafts 50 and 51 at axially central positions thereof, via torque limiters 52 and 53. The winding reel shafts 50 and 51 are rotatably bridged between the opposed side plates 31.

The first directing roller 41 and the second directing roller 42 are flanged rollers having flanges on opposite sides thereof. The first and second directing rollers 41 and 42 are respectively rotatably mounted on a first roller shaft 55 and a second roller shaft 56 which are supported between the opposed side plates 31. The tapes 36 and 37 respectively extending from the winding reels 38 and 39 toward the winding drum 40 go around the directing rollers 41 and 42, so that the tapes 36 and 37 are extended in a face-to-face relationship with a gap therebetween, so as to define a substantially triangular space 58 between the tapes 36 and 37. When a banknote is received, the space 58 functions so as to receive the banknote 45 and to allow the banknote 45 to be wound up by the winding drum 40 while the banknote 45 is sandwiched (interposed and held) between the tapes 36 and 37.

The respective guide rollers 43 and 44 are rotatably mounted on guide roller shafts 60 and 61 at axially central positions thereof. The guide roller shafts 60 and 61 are bridged between the opposed side plates 31.

The winding drum 40 includes a winding drum shaft 63 rotatably bridged between the opposed side plates 31, and a tape winding drum unit 64 positioned on an outer peripheral side of the winding drum shaft 63 so as to wind up the tapes 36 and 37.

Outside one of the side plates 31, pulleys of a smaller diameter, not shown, are mounted on the respective winding reel shafts 50 and 51, via one-way clutches, not shown. Further, a pulley of a large diameter, not shown, is mounted on the winding drum shaft 63. Furthermore, a drive pulley and a plurality of guide pulleys, not shown, are rotatably disposed outside the one of the side plates 31. An endless driving belt, not shown, goes around these pulleys 67 to 69. Moreover, a motor, not shown, which is the below-described drive unit 103 for driving the drive pulley in the regular and reverse directions, is installed outside the one of the side plates 31. Because of a difference between the diameters of the pulleys of the respective winding reel shafts 50 and 51, and the diameter of the pulley of the winding drum shaft 63, the respective winding reel shafts 50 and 51 are adapted to be always rotated at a rotational speed twice as fast as that of the winding drum shaft 63.

Due to the one-way clutches, a rotational driving force is transmitted to the respective winding reel shafts 50 and 51 only in directions corresponding to a tape winding-up direction (clockwise direction in FIG. 6) of each of the reels 38 and 39 for feeding a banknote, and the respective winding reel shafts 50 and 51 are rotated in the tape-winding up direction. The rotational driving force in a direction corresponding to a tape winding-off direction (counterclockwise direction in FIG. 6) of each of the winding reels 38 and 39 for receiving a banknote is shut off. When a banknote is received, the respective winding reel shafts 50 and 51 are prevented from being rotated in directions corresponding to the tape winding-off direction (counterclockwise direction in FIG. 6) by the one-way clutches.

A pair of transport rollers 75 are disposed in the banknote inlet/outlet port 35 facing the transport path 17. When a banknote is received, the pair of transport rollers 75 are configured to sandwich a banknote 45, which has been transported thereto by a pair of transport rollers 76 sandwiching the banknote 45, and to send the banknote 45 to between the tapes 36 and 37. When a banknote is fed, the pair of transport rollers 75 is configured to sandwich the banknote 45, which has been fed from between the tapes 36 and 37 that are wound off from the winding drum 40, and to feed the banknote 45 to the transport path 17. These transport rollers 75 are mounted on the respective roller shafts 55 and 56 on opposite sides of the respective directing rollers 41 and 42, so as to be rotated together with the roller shafts 55 and 56.

A first guide lever 78 is swingably supported on the first roller shaft 55. The first guide lever 78 is configured to guide one surface of a banknote 45 that is wound up by the winding drum 40 so as to be received, and to guide one surface of a banknote 45 that is wound off from the winding drum 40 so as to be fed. The first guide lever 78 is capable of being moved in compliance with increase or decrease of banknotes 45 to be wound up by the winding drum 40. A pair of pressing banknote pressing rollers 79 for pressing a banknote 45 from the tapes 36 and 37 toward the winding drum 40 are rotatably supported on the first guide lever 78 on the opposed sides.

A support shaft 81 is bridged between the opposed side plates 31 at a lateral position opposed to the winding drum 40. A proximal end of a swing lever 82 is mounted on a center of the support shaft 81. The swing lever 82 has an outer-diameter detecting unit 85 that detects the outer diameter $d_2$ of the tapes 36 and 37 wound up by the winding drum 40. A contact roller 83, which can come into contact with an outer peripheral surface of the unit by which the tapes 36 and 37 are wound up, is rotatably mounted on a distal end of the swing lever 82 by a contact roller shaft 84. The swing lever 82 is urged by an urging means e.g., a spring, such that the contact roller 83 is invariably in contact with the outer peripheral surfaces of the tapes 36 and 37 wound up by the winding drum 40. The support shaft 81 is located so as not to be interfered with by any member, even when the winding drum 40 winds up the maximum number of banknotes 45 so that the outer diameter $d_2$ of the tapes 36 and 37 takes the maximum value. The swing lever 82, the contact roller 83 and the urging means are adapted to detect the outer diameter $d_2$ of the tapes 36 and 37 wound up by the winding drum 40, and thus constitute the outer-diameter detecting unit 85 configured to detect the outer diameter $d_2$ of the tapes 36 and 37 wound up by the winding drum 40, while the number of the wound-up banknotes 45 changes from zero to the maximum.

A tape pressing member 87 is swingably supported on the second roller shaft 56. The tape pressing member 87 is configured to press the second tape 37 toward the first tape 36 such that the tapes 36 and 37 are in contact with each other, between the respective winding reels 38 and 39 and the winding drum 40, and between the respective guide rollers 41 and 42 and the transport rollers 75, and the winding drum 40. The tape pressing member 87 has a swing member 88 having a substantially U-shape, whose opposed ends are rotatably supported on the second roller shaft 56. A tape pressing roller 89, which can come into contact with the second tape 37 so as to press the same, is rotatably supported on a distal end of the swing member 88 by a tape pressing roller shaft 90. The tape pressing roller 89 is formed to have a width substantially the same as the widths of the tapes 36 and 37.

There is provided a moving means 92 that moves the tape pressing member 87 in accordance with the outer diameter $d_2$ of the tapes 36 and 37 wound up by the winding drum 40. The moving means 92 are structured by a cooperating mechanism 94 that connects the contact roller shaft 84 of the contact roller 83 and the tape pressing roller shaft 90 of the tape pressing roller 89 to each other by a link 93. The moving means 92 is configured to move the tape pressing member 87 cooperatively with the movement of the contact roller 83 in accordance with the outer diameter $d_2$ of the tapes 36 and 37 wound up by the winding drum 40.

Second guide levers 96 for guiding a banknote are mounted on the support shaft 81 on opposed sides of the swing lever 82. The second guide levers 96 are fixed on the support shaft 81, and can be swung together with the swing lever 82.

Between the winding drum 40 and the directing rollers 41 and 42, there are arranged banknote detecting sensors 98 for detecting a banknote 45 that passes therebetween so as to be received and fed. In addition, the transport path 17 is equipped with banknote detecting sensors 77 for detecting a banknote 45 that passes therebetween.

Next, a receiving operation of the storing and feeding unit 19 is described.

When a banknote 45 is transported from the transport path 17 toward the banknote storing and feeding unit 19, the banknote 45 is detected by the sensors disposed on the transport path 17. Thus, the not-shown motor is driven in rotation in a direction corresponding to the banknote receiving direction. Then, the winding drum 40 is rotated in the tape winding-up direction, so that the winding drum 40 starts to wind up the tapes 36 and 37.

On the other hand, the rotational driving force is not transmitted to the respective winding reel shafts 50 and 51 due to the one-way clutches, whereby the winding reel shafts 50 and 51 are not rotated in a direction corresponding to the tape winding-off direction in which the tapes 36 and 37 are wound off from the respective winding reels 38 and 39. In addition, since the rotations of the winding reel shafts 50 and 51 are prevented by the one-way clutches in a direction corresponding to the tape winding-off direction from the respective winding reels 38 and 39, the winding reels 38 and 39 respectively mounted on the winding reel shafts 50 and 51 via the torque limiters 52 and 53 are not rotated in the tape winding-off direction. Therefore, the tapes 36 and 37 wound up by the winding drum 40 are tensioned.

When the tensions applied to the tapes 36 and 37 exceed set torque values of the torque limiters 52 and 53, the torque limiters 52 and 53 slip, so that the winding reels 38 and 39 are rotated in the tape winding-off direction. Thus, the tapes are wound off from the winding reels 38 and 39, while certain tensions are applied to the tapes 36 and 37.

When the banknote 45 is transported from the transport path 17 to the banknote inlet/outlet port 35, a longitudinally central area of the banknote 45 is sandwiched between the pair of transport rollers 75. The pair of transport rollers 75 are rotated together with the directing rollers 41 and 42 that are rotated by the movements of the tapes 36 and 37, whereby the banknote 45 sandwiched between the pair of transport rollers 75 is sent to between the tapes 36 and 37.

The banknote 45 sent to between the tapes 36 and 37 is sandwiched between the tapes 36 and 37 at the position of the tape pressing roller 89 that presses the tapes 36 and 37 into contact with each other. Thereafter, the banknote 45 is wound up together with the tapes 36 and 37 by the winding drum 40 so as to be received.

At this time, the banknote 45 is guided toward the winding drum 40, with one surface of the banknote 45 being pressed by the first guide lever 78 and the other surface thereof being pressed by the second guide levers 96. Thus, when the banknote 45 is wound up, the banknote 45 is reluctant to be folded or curled on both sides in the depth direction of FIG. 6, whereby the banknote 45 can be smoothly wound up and received.

Further, the tapes 36 and 37 wound up by the winding drum 40 are pressed by the contact roller 83 so as to impart a fastening force to the tapes 36 and 37. Thus, the banknotes 45 can be wound up and received with a suitable fastening force. Moreover, owing to the fastening force, the increase in the outer diameter $d_2$ of the tapes 36 and 37 wound up by the winding drum 40, which increases as the number of the received banknotes 45 increases, can be restrained.

After the banknote detecting sensors 98 have detected the passage of the banknote 45 that is wound up and received by the winding drum 40, the not-shown motor is stopped at a timing when predetermined amounts of the tapes 36 and 37 are wound up or when a predetermined period elapses, whereby the winding up operation of the tapes 36 and 37 by the winding up drum 40 is stopped. In this manner, the receiving operation of receiving the one banknote 45 is completed.

When a predetermined number of banknotes 45 are received, the receiving operation is repeated predetermined times. When a plurality of banknotes 45 are transported in succession, the banknotes 45 may be wound up in succession, without stopping the winding operation.

Next, an operation for feeding a banknote is described.

The not-shown motor is driven in rotation in a direction corresponding to the banknote feeding direction. Thus, the winding drum 40 is rotated in the tape winding-off direction, whereby the tapes 36 and 37 start to be wound off from the winding drum 40.

On the other hand, the winding reel shafts 50 and 51 are rotated in a direction corresponding to the tape winding-up direction in which the tapes 36 and 37 are wound up by the winding reels 38 and 39. Due to the rotations of the winding reel shafts 50 and 51, the winding reels 38 and 39 are rotated in the tape winding-up direction via the torque limiters 52 and 53, so that the tapes 36 and 37 are wound up by the winding reels 38 and 39.

Due to the diameter ratio between the pulleys 67 of the winding reel shafts 50 and 51 and the pulley 68 of the winding drum shaft 63, the winding reels 38 and 39 of the winding reel shafts 50 and 51 are rotated faster than the winding drum 40 of the winding drum shaft 63. In addition, regardless of the ratio between the tape winding amounts of the winding reels 38 and 39 and the tape winding amount of the winding drum 40, the tape winding speeds at which the tapes 36 and 37 are wound up by the winding reels 38 and 39 are faster than the tape winding-off speed at which the tapes 36 and 37 are wound off from the winding drum 40. Thus, the tapes 36 and 37 wound up by the winding reels 38 and 39 are tensioned.

When the tensions applied to the tapes 36 and 37 exceed set torque values of the torque limiters 52 and 53, the torque limiters 52 and 53 slip, so that the winding reels 38 and 39 are rotated with certain torques at speeds slower than those of the winding reels shafts 50 and 51 in the tape winding-up direction. Thus, the tapes 36 and 37 are wound up by the winding reels 38 and 39, while certain tensions are applied to the tapes 36 and 37.

Thus, by winding off the tapes 36 and 37 from the winding drum 40, the banknote 45 is wound off together with the tapes 36 and 37. The banknote 45 to be wound off from the winding drum 40 passes the position at which the tape pressing roller 89 presses the tapes 36 and 37 into contact with each other. Thereafter, the banknote 45 is sandwiched between the transport rollers 75, and is fed to the transport path 17 from between the pair of transport rollers 75 through the banknote inlet/outlet port 35.

At this time, since the banknote 45 to be fed from the winding drum 40 to the banknote inlet/outlet port 35 is guided by the first guide lever 78 and the second guide levers 96, the banknote 45 is rarely caught up, whereby the banknote 45 can be smoothly fed.

When the number of the banknote 45 to be fed is one, the passage of the banknote 45 to be fed is detected by the banknote detecting sensors 98, and then the not-shown motor is stopped at a predetermined timing. Thus, the winding-off of the tapes 36 and 37 from the winding drum 40 and the winding-up of the tapes 36 and 37 by the winding reels 38 and 39 are stopped.

When a plurality of banknotes 45 are fed, even after the passage of one banknote 45 has been detected by the banknote detecting sensors 98, the not-shown motor is continuously driven. After the passage of the predetermined number of banknotes 45 to be fed has been detected by the banknote detecting sensors 98, the not-shown motor is stopped at a predetermined timing, so as to complete feeding of the plurality of banknotes 45.

Based on a control command of the control unit 102, the drive unit 103 is configured to drive the inlet 15, the transport path 17 and the storing and feeding unit 19, respectively.

Next, a basic concept of the embodiment of the present invention is described.

As described above, in the storing and feeding unit 19, when the outer peripheral length $l_2$ of the tapes 36 and 37 wound up together with the banknotes 45 becomes substantially equal to the storing pitch y between the banknotes 45 wound up by the winding drum 40, there occurs the problem in that the wound-up banknotes 45 are unevenly located on substantially the same position on the winding drum 40. On the other hand, when the outer peripheral length $l_2$ of the tapes 36 and 37 and the storing pitch y differ from each other to a certain degree or more, there is no possibility that the wound-up banknotes 45 are unevenly located on substantially the same position on the winding drum 40 because the distal ends of the banknotes are shifted. Thus, in order to eliminate the problem, the difference between the outer peripheral length $l_2$ of the tapes 36 and 37 and the storing pitch y has to be a certain value or more. Namely, the problem can be avoided by determining a predetermined range based on the outer peripheral length $l_2$ of the tapes 36 and 37 such that the storing pitch y deviates from the predetermined range. For example, when the predetermined range is $0.95\times l_2<y<1.05\times l_2$, the winding operation may be controlled such that y equals to $0.9\times l_2$ or y equals to $1.1\times l_2$ so as to deviate y from the predetermined range. In this case, since the banknotes 45 are wound up in shifted manner, with the shift (displacement) being 0.1 times the storing pitch y (i.e., when ten banknotes 45 are wound up, the start position for winding up the eleventh banknote 45 returns to the original position), the problem can be solved.

It is not necessary to determine which one of the outer peripheral length $l_2$ of the tapes 36 and 37 and the storing pitch y is larger or smaller. This is because, as long as the difference therebetween is a certain value or more, the above problem can be avoided, which is independent from whether one of the outer peripheral length $l_2$ of the tapes 36 and 37 and the storing pitch y is larger or smaller. However, in order to increase the number of banknotes to be wound up by the tapes 36 and 37 per unit length, it is preferable that the storing pitch y is smaller than the outer peripheral length $l_2$ of the tapes 36 and 37.

Since the outer peripheral length $l_2$ of the tapes 36 and 37 wound up by the winding drum 40 increases as the tapes 36 and 37 are wound up, it is impossible to control the outer peripheral length $l_2$ but it is possible to control the storing pitch y. The storing pitch y is a product of a cycle in which the banknotes 45 are transported (hereinafter referred to as "transport cycle") and winding amount of the tapes 36 and 37 per transport cycle. Thus, by controlling the transport cycle and the winding amount, the storing pitch y can be controlled. In the embodiment of the present invention, the storing pitch y is controlled such that the outer peripheral length $l_2$ of the tapes 36 and 37 wound up by the winding drum 40 differs from the storing pitch y by a predetermined length or more.

The control of the storing pitch y is performed by controlling at least one of the transport cycle and the winding amount of the tapes 36 and 37 per transport cycle. In the following embodiment, although a case in which only one of them is controlled is explained, the scope of the invention is not limited thereto.

In addition, the control of the transport cycle is performed by controlling a receiving cycle of the receiving unit. For example, when a tape winding speed is constant, an operation speed of the banknote feeding mechanism of the inlet 15 as the receiving unit is accelerated so as to reduce the receiving cycle, whereby the storing pitch is reduced. On the other hand, when the operation speed of banknote feeding mechanism of the inlet 15 is decelerated so as to elongate the receiving cycle, the storing pitch is elongated.

The control of the winding amount of the tapes 36 and 37 wound up by the winding drum 40 per transport cycle is performed by controlling the rotational speed of the winding drum 40. When the receiving cycle of the inlet 15 is constant, the storing pitch is reduced by decreasing the winding amount per receiving cycle. On the other hand, the storing pitch is elongated by increasing the winding amount per receiving cycle.

The tape winding speed at this time may be constant, or may be varied under a predetermined condition. In addition, an angular speed of the winding drum 40 during the winding operation may be constant, and the angular speed of the winding drum 40 may be varied each time when the tapes 36 and 37 of predetermined lengths are wound up. Since the tapes 36 and 37 and the banknotes are thin, when the tapes are wound up only for a while, the increase in the outer peripheral length $l_2$ of the tapes 36 and 37 is small. Thus, even when the angular speed of the winding drum 40 is constant, the variation of the tape winding speed is small. Therefore, by varying the angular speed of the winding drum 40 at suitable intervals, the tape winding speed can be maintained substantially uniform.

In general, as disclosed in JP2000-123219A and JP8-67382A, it is desirable that the tape winding amount per receiving cycle is not less than a transport distance per receiving cycle. On the other hand, in the banknote processing device in the embodiment of the present invention, the tape winding amount per receiving cycle may be smaller than the transport distance per receiving cycle. However, in a case where the tape winding speed is slower than the transport speed of the transport path 17, when a banknote is transferred from the transport path 17 to the storing and feeding unit 19, since the downstream side speed is slower, there is a possibility that the banknote might become loose. Thus, special consideration has to be taken thereinto. For example, during a long edge feed, a time period for which the banknote tends to become loose is short, so that the loose amount is small. However, during a short edge feed, a time period for which the banknote tends to become loose is longer than the time period during the long edge feed, so that the loose amount is larger. The increase in the loose amount may result in an abnormal case in which a wrinkled banknote is wound up and/or the device jams. Thus, particularly in a case of the short edge feed, it is preferable that, when a banknote is transferred from the transfer path 17 to the storing and feeding unit 19, the tape winding speed is not less than the transport speed of the transport path 17.

In the control of the storing pitch y performed as described above, in the throughout process of the storing and feeding unit 19 from when the number of stored banknotes is zero until the number of stored banknotes reaches the maximum, the storing pitch y preventing the above problem may be maintained constant, or may be varied based on the relationship between the storing pitch y and the outer peripheral length $l_2$ of the tapes 36 and 37 so as to prevent the above problem.

Example 1

Next, process contents of the banknote processing device 11 in Example 1 of the present invention are described with reference to FIGS. 8 to 10. In Example 1 of the present invention, by decelerating the tape winding speed, a storing pitch of a banknote receiving and feeding device, which includes a winding drum having an outer peripheral length that is smaller than a transport pitch determined based on a predetermined receiving cycle and a predetermined transport speed, is controlled such that the storing pitch is smaller than the outer peripheral length of the winding drum by a predetermined length or more, from when the number of stored banknotes is zero.

Figure 8:
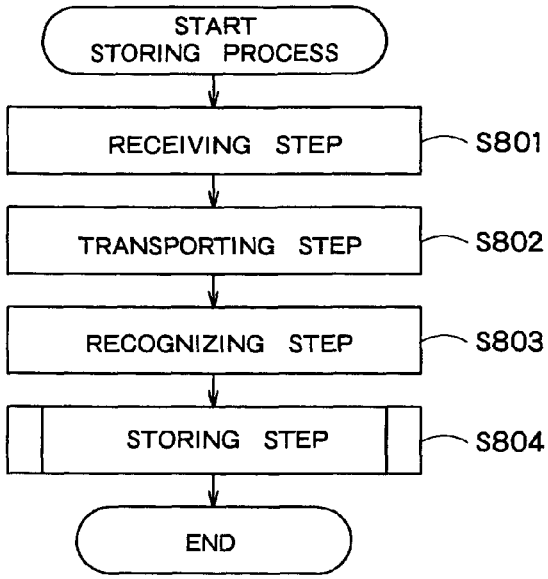
FIG. 8 is a flowchart showing a process procedure of a control unit 102 in a storing process in which banknotes are received by the storing and feeding unit 19 of the banknote processing device 11 in the embodiment of the present invention.
Figure 9:
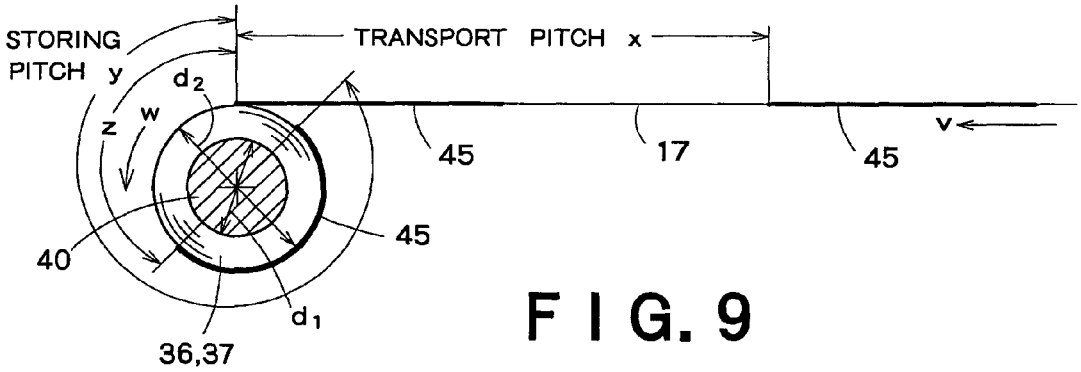
FIG. 9 is a schematic view showing a relationship between a transport path 17, a winding roller 40 and banknotes 45.

FIG. 8 is a flowchart showing a process procedure of the control unit 102 in a storing process in which banknotes are received by the storing and feeding unit 19 and stored there in the banknote processing device 11 in the embodiment of the present invention. The storing process is performed when a banknote is temporarily stored, as shown in FIG. 2(*a*), in the deposit process. Similarly, the storing process is performed in the dispensing process, when a banknote 45 is temporarily stored before the banknote 45 is sent to the outlet 16. In this case, the stacker 20 serves as the receiving unit.

At first, in a receiving step (S801), the control unit 102 controls the drive unit 103 such that the inlet 15 receives banknotes 45 placed therein one by one in a predetermined cycle t.

Then, in a transporting step (S802), the control unit 102 controls the drive unit 103 such that the transport unit (transport path 17) transports the banknotes 45 received in the receiving step (S801) at a predetermined transport speed v. As shown in FIG. 9, since the banknotes 45 received in the predetermined cycle t in the receiving step (S801) are transported at the predetermined transport speed v, a transport pitch x is a product of the receiving cycle t and the transport speed v. An outer peripheral length $l_1$ of the winding drum 40 is a value determined by an outer diameter $d_1$ of the winding drum 40.

Then, in a recognizing step (S803), the control unit 102 controls the recognition unit 18 such that the denomination, the authentification and the fitness of each banknote 45 transported along the transport path 17 in the transporting step (S802) are recognized. The recognition result of the recognition unit 18 is transmitted to the control unit 102.

Then, in a storing step (S804), the banknotes 45 transported from the recognition unit 18 to the storing and feeding unit 19 are sandwiched between the tapes 36 and 37, and are wound up by the winding drum 40. As shown in FIG. 9, a storing pitch y between the wound-up banknote 45 and the next banknote 45 is a length of the tapes 36 and 37 wound up by the winding drum 40 during the predetermined receiving cycle t, starting from winding up of the former banknote 45. A stored distance z is a value obtained by deducting the length of the wound-up banknote 45 from the storing pitch y. An outer peripheral length $l_2$ of the tapes 36 and 37 wound up by the winding drum 40 is a value determined by an outer diameter $d_2$ of the tapes 36 and 37 wound up by the winding drum 40.

This storing process is performed repeatedly to all the banknotes 45 placed in the inlet 15, until the receiving step (S801) to the storing step (S804) are finished.

Figure 10:
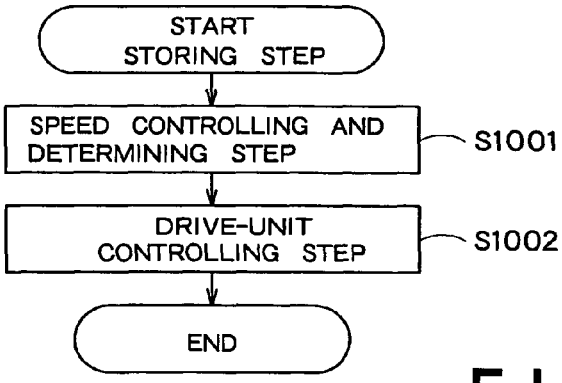
FIG. 10 is a flowchart showing a process procedure of the control unit 102 in a storing step (S804) of FIG. 8.
Figure 11:
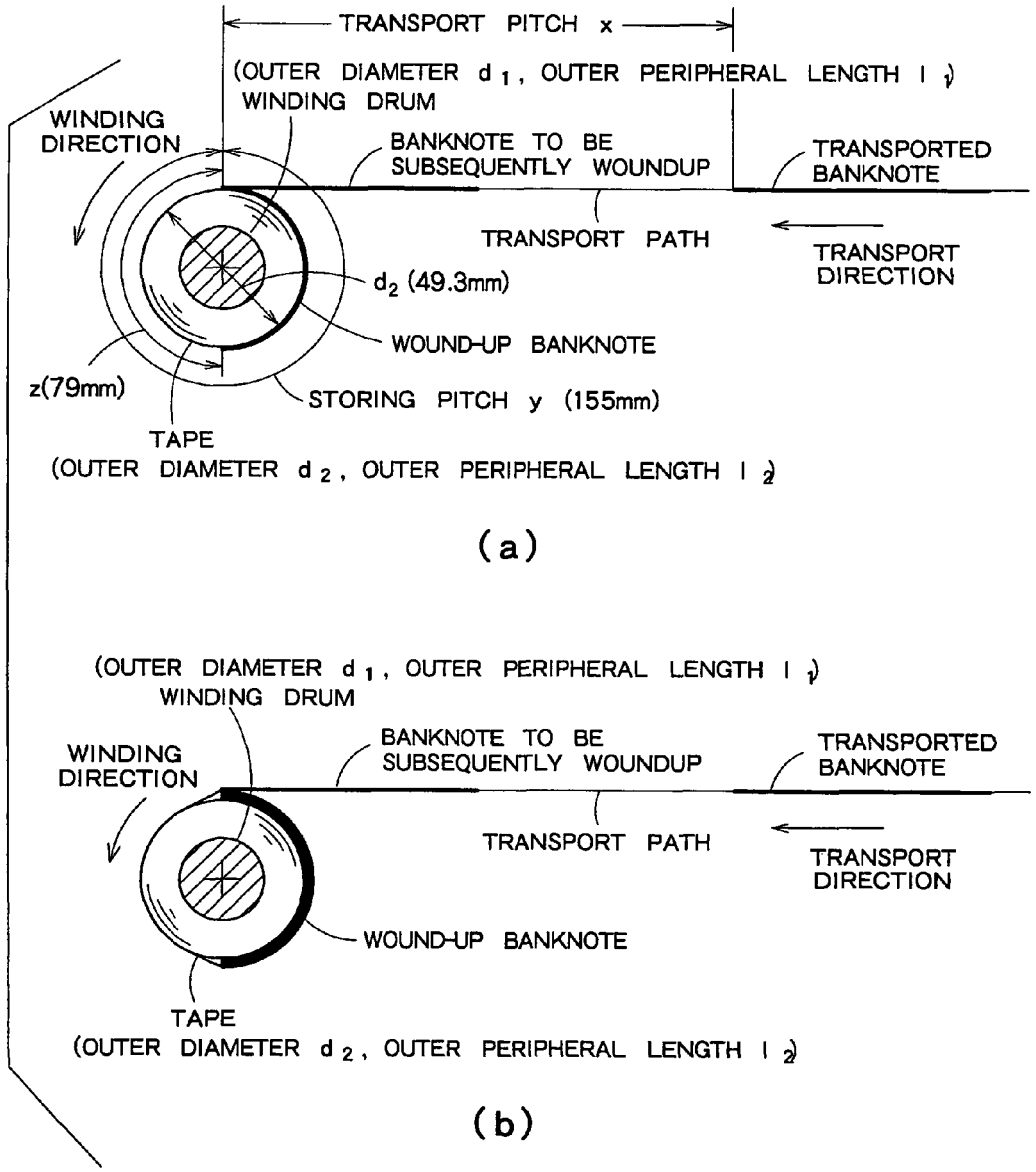
FIG. 11 is a schematic view showing a problem occurring in a conventional banknote processing device.

FIG. 10 is a flowchart showing a process procedure of the control unit 102 in the storing step (S804) in FIG. 8.

At first, in a speed controlling and determining step (S1001), the control unit 102 determines a tape winding speed of the winding drum 40 such that the tapes 36 and 37 are wound up at a predetermined constant speed. The tape winding speed is determined such that the storing pitch y determined by the receiving cycle t and the tape winding speed is smaller than the outer diameter $d_1$ of the winding drum by a predetermined amount.

For example, the winding-up operation is started from a condition in which no tape 36 or 37 is wound up by the winding drum 40. At this time, when the predetermined amount is determined as 10% the outer diameter $d_1$ of the winding drum, the wound-up positions of the banknotes 45 are displaced (shifted) for each time when the one banknote 45 is wound up. Then, the wound-up position returns to substantially the original position when the eleventh banknote 45 is stored. On the other hand, when the predetermined amount is determined as 5% the outer diameter $d_1$ of the winding drum, the wound-up position returns to substantially the original position when the twenty first banknote is stored. As the number of the wound-up banknotes 45 increases, the outer diameter $d_2$ of the tapes 36 and 37 increases. Thus, the banknotes 45 can be stored, without the storing pitch y becoming substantially the same as the outer peripheral length $l_2$ of the tapes 36 and 37.

Then, in a drive-unit controlling step (S1002), the control unit 102 controls the drive unit 103 such that the tapes 36 and 37 are wound up at the tape winding speed that has been determined in the speed controlling and determining step (S1001), so as to wind up the banknotes 45. At this time, the control unit 102 calculates the speeds of the tapes 36 and 37 based on a timing at which the marks on the tapes 36 and 37 are detected by the first and second winding amount sensors 47 and 48 and a time period measured by the timer means. Then, the control unit 102 controls the rotation of the winding drum 40 such that the speeds of the tapes 36 and 37 correspond to the tape winding speed that has been determined in the speed controlling and determining step (S1001).

In Example 1 of the present invention, there has been explained the case in which the storing pitch y is controlled such that the storing pitch y is maintained smaller than the outer peripheral length $l_2$ of the tapes 36 and 37 by a predetermined length or more, from when the number of stored banknotes is zero. However, on the contrary, by accelerating the tape winding speed, the storing pitch y may be controlled to be larger than the outer peripheral length $l_2$ of the tapes 36 and 37 by a predetermined amount or more, from when the number of stored banknotes is zero until the number of stored banknotes reaches the maximum.

In the speed controlling and determining step (S1001) of Example 1 of the present invention, the tape winding speed is constant. However, while one banknote 45 is wound up, the tape winding speed may be varied. For example, when the banknote 45 is transferred from the transport path 17 to the storing and feeding unit 19, the transport speed v and the tape winding speed may be controlled so as to be substantially equal to each other. Then, after the banknote 45 has been transferred from the transport path 17 to the storing and feeding unit 19, the tape winding speed may be determined such that the transport speed v is faster or slower than the tape winding speed.

In the drive-unit controlling step (S1002) of Example 1 of the present invention, the tape winding speed may be controlled by another method. For example, the outer peripheral length $l_2$ of the tapes 36 and 37 may be calculated based on the outer diameter $d_2$ of the tapes 36 and 37 detected by the outer-diameter detecting unit 85, and the tape winding speed may be calculated from the outer peripheral length $l_2$ of the tapes 36 and 37 and the rotational speed w of the winding drum 40. Then, the winding drum 40 may be controlled such that the tape winding speed corresponds to the tape winding speed that has been determined in the speed controlling and determining step (S1001). Alternatively, a relationship between the winding amount of the tapes 36 and 37 or the number of the wound-up banknotes 45 and the rotational speed w of the winding drum 40 is determined with the use of a relational expression or a table, and the rotation of the winding drum 40 may be controlled based on the relationship.

In Example 1 of the present invention, although there has been explained the case in which the storage pitch y is constantly controlled from when the number of stored banknotes is zero until the number of stored banknotes reaches the maximum, the scope of the present invention is not limited thereto. Based on the outer peripheral length $l_2$ of the tapes 36 and 37 calculated based on the outer diameter $d_2$ of the tapes 36 and 37 detected by the outer-diameter detecting unit 85, the winding amount of the tapes 36 and 37, or the number of the stored banknotes 45, the tape winding speed may be controlled according to need. For example, when the number of stored banknotes is zero, the tape winding speed is controlled such that the storing pitch y is substantially equal to the transport pitch x. When the storing pitch y falls within a predetermined range relative to the outer peripheral length $l_2$ of the tapes 36 and 37, the tape winding speed may be varied such that the storing pitch y is longer (or shorter) than the outer peripheral length $l_2$ of the tapes 36 and 37 by a predetermined length or more, so as to continue the winding-up operation. At this time, when the storing pitch y deviates again from the predetermined range relative to the outer peripheral length $l_2$ of the tapes 36 and 37, the tape winding speed may be again controlled such that the storing pitch y is substantially equal to the transport pitch x.

According to Example 1 of the present invention, the banknotes 45 are stored such that the storing pitch y deviates from the predetermined range relative to the outer peripheral length $l_2$ of the tapes 36 and 37. Thus, it is possible to eliminate the problem in which the banknotes 45 stored in the storing and feeding unit 19 including the winding drum 40 are unevenly wound up on the winding drum 40. Therefore, the diameter of the winding drum 40 can be reduced, for example, whereby the capacity of the storing and feeding unit 19 can be improved.

Example 2

Next, process contents of the paper processing device 11 in Example 2 of the present invention are described with reference to FIG. 10. In Example 2 of the present invention, by elongating a receiving cycle in a predetermined section, a storing pitch of a banknote receiving and feeding device, which includes a winding drum having an outer peripheral length that is smaller than a transport pitch determined based on a predetermined receiving cycle and a predetermined transport speed, is controlled such that the storage pitch deviates from a predetermined range relative to the outer peripheral length of the tapes. Similarly to the transport speed, the tape winding speed is controlled to be constant, from when the number of stored banknotes is zero until the number of stored banknotes reaches the maximum. The description similar to that of Example 1 of the present invention is omitted.

At first, in an initial state, in the speed controlling and determining step (S1001), a first receiving cycle $t_1$ by which the storing pitch y is larger than the outer peripheral length $l_1$ of the winding drum 40 and deviates from a predetermined range, and a tape winding speed is determined. Thereafter, in the drive-unit controlling step (S1002), the inlet 15 receives the banknotes 45 placed therein one by one in the first receiving cycle $t_1$. At this time, the tapes 36 and 37 are wound up by the winding drum 40 at the tape winding speed that has been determined in the speed controlling and determining step (S1001). As a result, the outer peripheral length $l_2$ of the tapes 36 and 37 increases, and the storing pitch y falls within the predetermined range relative to the outer peripheral length $l_2$ of the tapes 36 and 37.

In the drive-unit controlling step (S1002), whether the storing pitch y deviates from the predetermined range or not relative to the outer peripheral length $l_1$ of the tapes 36 and 37 is monitored. When the storing pitch y falls within the predetermined range, the control unit 102 varies the receiving cycle t of the inlet 15 from the first receiving cycle $t_1$ to a second receiving cycle $t_2$ ($t_2>t_1$) by which the storing pitch y deviates from the predetermined range, and continues the winding up of the banknotes 45. As a result, the outer peripheral length $l_2$ of the tapes 36 and 37 increases, whereby the storing pitch y deviates from the predetermined range relative to the outer peripheral length $l_2$ of the tapes 36 and 37.

Then, the control unit 102 varies the receiving cycle t from the second receiving cycle $t_2$ to the first receiving cycle and continues the winding up of the banknotes 45 until a finishing requirement occurs.

In Example 2 of the present invention, although there has been explained the case in which the receiving cycle t is varied from the first receiving cycle $t_1$ to the second receiving cycle $t_2$, and the second receiving cycle $t_2$ is again returned to the first receiving cycle $t_1$, the second receiving cycle $t_2$ may not be returned to the first receiving cycle $t_1$. In addition, the receiving cycle t may start from the second receiving cycle $t_2$ and terminate on the first receiving cycle $t_1$. In addition, the receiving cycle t may not be limited to the two cycles, and may be composed of three or more cycles.

In Example 2 of the present invention, there has been explained the case in which the storing pitch y is controlled so as to deviate from the predetermined range relative to the outer peripheral length $l_2$ of the tapes 36*a* and 37, by elongating the receiving cycle t of the inlet 15 in a section in which the storing pitch might fall within the predetermined range relative to the outer peripheral length $l_2$ of the tapes 36 and 37. However, on the contrary, the storing pitch y may be controlled so as to deviate from the predetermined range relative to the outer peripheral length $l_2$ of the tapes 36*a* and 37, by reducing the receiving cycle t of the inlet 15.

In Example 2 of the present invention, there has been explained the case in which the receiving cycle t of the inlet 15 is varied based on whether the string pitch y falls within the predetermined range relative to the outer peripheral length $l_2$ of the tapes 36 and 37. However, such a control may be performed when a value correlating with the outer peripheral length $l_2$ of the tapes, such as the winding amount of the tapes 36 and 37, the number of stored banknotes 45, or the outer diameter $d_2$ of the tapes 36 and 37 detected by the outer-diameter detecting unit 85, falls within a predetermined range thereof. In this case, a range corresponding to the predetermined range relative to the outer peripheral length $l_2$ of the tapes 36 and 37 has to be determined for the winding amount of the tapes 36 and 37, the number of stored banknotes 45, or the outer diameter $d_2$ of the tapes 36 and 37.

In Example 2 of the present invention, by using at least the two receiving cycles t (the first receiving cycle $t_1$ and the second receiving cycle $t_2$), the inlet 15 is controlled such that, instead of one receiving cycle t (first receiving cycle $t_1$) which invites the problem, the inlet 15 receives the banknotes 45 in the other receiving cycle t (second receiving cycle $t_2$) which prevents the problem. Thus, it is possible to eliminate the problem in which the banknotes 45 stored in the storing and feeding unit 19 including the winding drum 40 are unevenly wound up on the winding drum 40. Therefore, the diameter of the winding drum 40 can be reduced, for example, whereby the capacity of the storing and feeding unit 19 can be improved.

In Examples 1 and 2 of the present invention, there has been explained the case in which the banknotes are received from the inlet 15 as the receiving unit. However, as long as the unit has a function for feeding the banknotes 45 one by one in a predetermined receiving cycle t, any other unit can serve as the receiving unit. For example, a stacker 20 as the receiving unit can receive the banknotes 45. In addition, the receiving unit may be an inlet/outlet port serving as both the inlet 15 and the outlet 16.

In Examples 1 and 2 of the present invention, there has been explained the case in which, during one storing process for storing all the banknotes 45 placed in the inlet 15, the storing pitch y is varied by varying the tape winding amount per receiving cycle t or the receiving cycle t. However, the storing pitch y may be varied, not only in the course of the one process. For example, between a precedent process which has been finished and a subsequent process which is to be started, the storing pitch y to be used in the subsequent process may be varied from the storing pitch y used in the precedent process, by varying the tape winding amount per receiving cycle t or the receiving cycle t.

The invention claimed is:

1. A paper sheet processing device for processing paper sheets, the paper sheet processing device comprising:

a receiving unit configured to receive paper sheets one by one in a predetermined receiving cycle;

a transport unit configured to transport the paper sheets received by the receiving unit;

a storing and feeding unit including a winding drum that winds up the paper sheets together with a tape, the storing and feeding unit being configured to receive and feed the paper sheets transported by the transport unit, by winding up and winding off the tape;

a drive unit configured to drive the receiving unit, the transport unit, and the storing and feeding unit: and a control unit configured to control the drive unit to maintain a tape winding amount per receiving cycle, such that a storing pitch of the paper sheets wound up by the winding drum deviates from a predetermined range relative to an outer peripheral length of the tape wound up by the winding drum.

2. The paper sheet processing device according to claim 1, wherein an outer peripheral length of the winding drum is smaller than a transport pitch of the paper sheets, which is determined based on the receiving cycle and a transport speed of the transport unit.

3. The paper sheet processing device according to claim 1, wherein the storing pitch is smaller than the outer peripheral length of the winding drum.

4. The paper sheet processing device according to claim 1, wherein the tape winding amount per receiving cycle is smaller than a transport distance of the transport unit per receiving cycle.

5. A paper sheet processing device for processing paper sheets, the paper sheet processing device comprising:

a receiving unit configured to receive paper sheets one by one in a predetermined receiving cycle;

a transport unit configured to transport the paper sheets received by the receiving unit;

a storing and feeding unit including a winding drum that winds up the paper sheets together with a tape, the storing and feeding unit being configured to receive and feed the paper sheets transported by the transport unit, by winding up and winding off the tape;

a drive unit configured to drive the receiving unit, the transport unit, and the storing and feeding unit: and a control unit configured to control the drive unit to vary the storing pitch, such that a storing pitch of the paper sheets wound up by the winding drum deviates from a predetermined range relative to an outer peripheral length of the tape wound up by the winding drum.

6. The paper sheet processing device according to claim 5, wherein the control unit is configured to vary the receiving cycle so as to vary the storing pitch.

7. The paper sheet processing device according to claim 5, wherein the control unit is configured to vary a rotational amount of the winding drum per receiving cycle so as to vary the storing pitch.

8. A method of controlling a paper sheet processing device including: a receiving unit configured to receive paper sheets one by one in a predetermined receiving cycle; a transport unit configured to transport the paper sheets received by the receiving unit; and a storing and feeding unit including a winding drum that winds up the paper sheets together with a tape, the storing and feeding unit being configured to receive and feed the paper sheets transported by the transport unit, by winding up and winding off the tape; wherein the respective units are controlled such that a storing pitch of the paper sheets wound up together with the tape deviates from a predetermined range relative to an outer peripheral length of the tape wound up by the winding drum.

* * * * *